US009033751B2

(12) United States Patent
Sato

(10) Patent No.: US 9,033,751 B2
(45) Date of Patent: May 19, 2015

(54) CONNECTOR TERMINAL

(71) Applicant: YAZAKI CORPORATION, Tokyo (JP)

(72) Inventor: Kei Sato, Shizuoka (JP)

(73) Assignee: YAZAKI CORPORATION, Tokyo (JP)

( * ) Notice: Subject to any disclaimer, the term of this patent is extended or adjusted under 35 U.S.C. 154(b) by 22 days.

(21) Appl. No.: 14/107,141

(22) Filed: Dec. 16, 2013

(65) Prior Publication Data

US 2014/0106628 A1 Apr. 17, 2014

Related U.S. Application Data

(63) Continuation of application No. PCT/JP2012/079720, filed on Nov. 9, 2012.

(30) Foreign Application Priority Data

Nov. 11, 2011 (JP) ..... 2011-247619

(51) Int. Cl.
*H01R 4/18* (2006.01)
*H01R 4/20* (2006.01)

(52) U.S. Cl.
CPC ..... *H01R 4/206* (2013.01); *H01R 4/184* (2013.01); *H01R 4/188* (2013.01); *H01R 4/20* (2013.01)

(58) Field of Classification Search
CPC ..... H01R 4/188; H01R 4/185; H01R 4/62; H01R 4/184; H01R 4/187
See application file for complete search history.

(56) References Cited

U.S. PATENT DOCUMENTS

| | | | | | |
|---|---|---|---|---|---|
| 2,854,648 | A * | 9/1958 | Berg | 439/867 |
| 3,510,829 | A * | 5/1970 | Keller | 439/421 |
| 3,812,448 | A * | 5/1974 | Haitmanek | 439/421 |
| 3,892,459 | A * | 7/1975 | Dittmann et al. | 439/442 |
| 4,003,623 | A * | 1/1977 | Reynolds | 439/395 |
| 5,532,433 | A * | 7/1996 | Endo et al. | 174/84 C |
| 6,056,605 | A * | 5/2000 | Nguyen et al. | 439/882 |
| 6,334,798 | B1 * | 1/2002 | Ushijima et al. | 439/879 |
| 6,666,732 | B1 * | 12/2003 | Endacott | 439/874 |
| 6,749,457 | B2 * | 6/2004 | Sakaguchi et al. | 439/421 |

(Continued)

FOREIGN PATENT DOCUMENTS

| | | |
|---|---|---|
| JP | 2001-162647 A | 6/2001 |
| WO | 2011/118628 A1 | 9/2011 |

(Continued)

OTHER PUBLICATIONS

International Search Report and Written Opinion of the International Search Report for PCT/JP2012/079720 dated Mar. 6, 2013.

*Primary Examiner* — Ross Gushi
(74) *Attorney, Agent, or Firm* — Kenealy Vaidya LLP

(57) ABSTRACT

In a connector terminal connected to an electric wire in which a conductor is covered with an outer cover, the terminal includes a barrel portion that is exposed from the outer cover and is to be crimped to the conductor coated with a covering, and an electrical connection portion electrically connected to a mating terminal, wherein a trench or a projection that is provided along a direction perpendicular to an axis of the electric wire are formed in an inner surface of the barrel portion, and a depth of the trench or a projecting dimension of the projection is made smaller than a covering thickness of the covering.

4 Claims, 5 Drawing Sheets

(56) References Cited

U.S. PATENT DOCUMENTS

| | | | | |
|---|---|---|---|---|
| 7,115,004 | B2 * | 10/2006 | Takayama | 439/852 |
| 7,174,633 | B2 * | 2/2007 | Onuma | 29/854 |
| 7,210,958 | B1 * | 5/2007 | Jacques et al. | 439/421 |
| 7,374,466 | B2 * | 5/2008 | Onuma et al. | 439/874 |
| 7,544,892 | B2 * | 6/2009 | Susai et al. | 174/84 R |
| 7,722,416 | B2 * | 5/2010 | Gump et al. | 439/879 |
| 7,824,235 | B2 * | 11/2010 | Yang | 439/874 |
| 7,867,014 | B2 * | 1/2011 | Kuwayama | 439/452 |
| 7,905,755 | B1 * | 3/2011 | Martauz | 439/877 |
| 7,954,235 | B2 * | 6/2011 | Martauz et al. | 29/855 |
| 7,960,652 | B2 * | 6/2011 | Drew et al. | 174/74 R |
| 8,052,466 | B2 * | 11/2011 | Okamoto | 439/585 |
| 8,147,281 | B2 * | 4/2012 | Kuwayama et al. | 439/877 |
| 8,177,591 | B2 * | 5/2012 | Okamura et al. | 439/877 |
| 8,181,343 | B2 * | 5/2012 | Martauz et al. | 29/863 |
| 8,210,884 | B2 * | 7/2012 | Corman et al. | 439/877 |
| 8,221,171 | B2 * | 7/2012 | Ono et al. | 439/877 |
| 8,245,396 | B2 * | 8/2012 | Kondo et al. | 29/863 |
| 8,246,394 | B2 * | 8/2012 | Ono et al. | 439/877 |
| 8,266,798 | B2 * | 9/2012 | Martauz | 29/855 |
| 8,303,354 | B2 * | 11/2012 | Ootsuka et al. | 439/877 |
| 8,303,355 | B2 * | 11/2012 | Ono et al. | 439/877 |
| 8,303,356 | B2 * | 11/2012 | Nishide | 439/877 |
| 8,337,262 | B2 * | 12/2012 | Ono et al. | 439/877 |
| 8,425,266 | B2 * | 4/2013 | Ono et al. | 439/877 |
| 8,430,700 | B2 * | 4/2013 | Ono et al. | 439/877 |
| 8,485,853 | B2 * | 7/2013 | Seifert et al. | 439/882 |
| 8,519,267 | B2 * | 8/2013 | Peters et al. | 174/77 R |
| 8,607,449 | B2 * | 12/2013 | Kitagawa et al. | 29/863 |
| 8,622,774 | B2 * | 1/2014 | Seifert et al. | 439/882 |
| 8,622,775 | B2 * | 1/2014 | Takashima et al. | 439/886 |
| 8,641,461 | B2 * | 2/2014 | Mitose et al. | 439/877 |
| 8,804,134 | B2 * | 8/2014 | Onuma | 356/614 |
| 8,814,611 | B2 * | 8/2014 | Onuma et al. | 439/877 |
| 8,814,612 | B2 * | 8/2014 | Onuma et al. | 439/877 |
| 8,834,213 | B2 * | 9/2014 | Sato et al. | 439/866 |
| 8,851,941 | B2 * | 10/2014 | Onuma | 439/877 |
| 8,858,275 | B2 * | 10/2014 | Onuma et al. | 439/877 |
| 8,870,611 | B2 * | 10/2014 | Sato et al. | 439/877 |
| 8,870,612 | B2 * | 10/2014 | Onuma et al. | 439/877 |
| 8,876,563 | B2 * | 11/2014 | Onuma et al. | 439/877 |
| 8,876,564 | B2 * | 11/2014 | Sato | 439/879 |
| 8,882,549 | B2 * | 11/2014 | Suzuki | 439/882 |
| 8,900,010 | B2 * | 12/2014 | Aoki et al. | 439/587 |
| 8,900,020 | B2 * | 12/2014 | Aoki et al. | 439/851 |
| 8,944,862 | B2 * | 2/2015 | Sato | 439/877 |
| 2002/0028612 | A1 * | 3/2002 | Ushijima et al. | 439/879 |
| 2002/0072278 | A1 * | 6/2002 | Duck | 439/877 |
| 2005/0227549 | A1 * | 10/2005 | Takayama | 439/851 |
| 2010/0087104 | A1 * | 4/2010 | Gump et al. | 439/877 |
| 2010/0230160 | A1 * | 9/2010 | Ono et al. | 174/84 |
| 2010/0297894 | A1 * | 11/2010 | Ootsuka et al. | 439/877 |
| 2011/0003518 | A1 * | 1/2011 | Ono et al. | 439/877 |
| 2011/0009014 | A1 * | 1/2011 | Ono et al. | 439/877 |
| 2011/0083324 | A1 * | 4/2011 | Martauz et al. | 29/863 |
| 2011/0124247 | A1 * | 5/2011 | Okamura et al. | 439/877 |
| 2012/0178316 | A1 * | 7/2012 | Sato | 439/877 |
| 2012/0329318 | A1 * | 12/2012 | Aoki et al. | 439/521 |
| 2012/0329342 | A1 * | 12/2012 | Sato | 439/866 |
| 2012/0329343 | A1 | 12/2012 | Sato et al. | |
| 2013/0005197 | A1 * | 1/2013 | Sato | 439/741 |
| 2013/0040509 | A1 * | 2/2013 | Mitose et al. | 439/877 |
| 2013/0045644 | A1 * | 2/2013 | Aoki et al. | 439/878 |
| 2013/0095708 | A1 * | 4/2013 | Mitose et al. | 439/878 |
| 2013/0115828 | A1 * | 5/2013 | Seifert et al. | 439/877 |
| 2013/0130564 | A1 * | 5/2013 | Onuma et al. | 439/877 |
| 2013/0130566 | A1 * | 5/2013 | Onuma et al. | 439/877 |
| 2013/0130567 | A1 * | 5/2013 | Onuma et al. | 439/877 |
| 2013/0130568 | A1 * | 5/2013 | Onuma et al. | 439/877 |
| 2013/0130569 | A1 * | 5/2013 | Sato | 439/882 |
| 2013/0130570 | A1 * | 5/2013 | Onuma et al. | 439/882 |
| 2014/0004757 | A1 * | 1/2014 | Matsushita et al. | 439/877 |
| 2014/0004758 | A1 * | 1/2014 | Kondou et al. | 439/877 |
| 2014/0004759 | A1 * | 1/2014 | Kondou et al. | 439/878 |
| 2014/0106628 | A1 * | 4/2014 | Sato | 439/877 |
| 2014/0151083 | A1 * | 6/2014 | Ohnuma et al. | 174/93 |
| 2014/0206244 | A1 * | 7/2014 | Kato | 439/878 |
| 2014/0213123 | A1 * | 7/2014 | Ito et al. | 439/877 |
| 2014/0224536 | A1 * | 8/2014 | Ito | 174/84 |
| 2014/0262501 | A1 * | 9/2014 | Stol et al. | 174/94 R |
| 2015/0011116 | A1 * | 1/2015 | Ohnuma | 439/519 |
| 2015/0011117 | A1 * | 1/2015 | Ohnuma | 439/520 |
| 2015/0017833 | A1 * | 1/2015 | Sato et al. | 439/519 |

FOREIGN PATENT DOCUMENTS

| | | | |
|---|---|---|---|
| WO | 2011/122622 | A1 | 10/2011 |
| WO | 2011/125559 | A1 | 10/2011 |

* cited by examiner

CONNECTOR TERMINAL

CROSS REFERENCE TO RELATED APPLICATIONS

This application is a continuation of PCT application No. PCT/JP2012/079720, which was filed on Nov. 9, 2012 based on Japanese Patent Application (No. 2011-247619) filed on Nov. 11, 2011, the contents of which are incorporated herein by reference.

BACKGROUND OF THE INVENTION

1. Field of the Invention

The invention relates to a connector terminal connected to a terminal of an electric wire.

2. Description of the Related Art

In order to protect a connection portion of a connector terminal that is to be connected to a terminal of an electric wire, a hitherto known technique is to secure, within a molding die assembly including an upper die and a lower die, a hollow molding region into which a terminal connection portion made by crimping terminal hardware to a forefront conductor of a covered electric wire is to be set and accommodated. A molten molding resin is injected into the molding region, thereby covering and molding the terminal connection portion (see; for instance, JP-A-2001-162647).

SUMMARY OF THE INVENTION

As mentioned above, after being subjected to processing pertaining to a crimping step in which an electric wire is crimped, the connector terminal whose crimped connection portion has been molded is taken out of a crimper and delivered to a molding machine. The molding machine performs processing pertaining to a molding step in which a resin mold is formed by injecting the molding resin. Therefore, the molding machine for performing processing pertaining to the molding step and a resin material for molding purpose are necessary, which adds to costs of facilities and manufacturing costs.

The invention has been conceived in light of the circumstance and aims at providing a connector terminal that can be connected to an electric wire without fail and exhibit a superior anticorrosion property at a connection portion of the connector terminal to be connected to a conductor while saving costs of facilities and manufacturing costs is achieved.

In order to accomplish the object, a connector terminal of the invention has characteristics (1) through (4) provided below.

(1) A connector terminal connected to an electric wire in which a conductor is covered with an outer cover, the terminal including a barrel portion that is exposed from the outer cover and is to be crimped to the conductor coated with a covering, and an electrical connection portion electrically connected to a mating terminal, wherein a trench or a projection that is provided along a direction perpendicular to an axis of the electric wire are formed in an inner surface of the barrel portion, and a depth of the trench or a projecting dimension of the projection is made smaller than a covering thickness of the covering.

(2) In the connector terminal defined in (1), the barrel portion includes a sealing piece that seals a forefront of the conductor when the conductor is crimped.

(3) In the connector terminal defined in (1), the barrel portion is divided into a core wire crimping portion crimping the conductor and an outer cover crimping portion crimping the outer cover.

(4) In the connector terminal defined in (2), the barrel portion is divided into a core wire crimping portion crimping the conductor and an outer cover crimping portion crimping the outer cover.

In the connector terminal having the configuration defined in (1), the conductor covered with the covering bites into the trench or projection formed in an inner surface of the barrel portion oriented along the direction perpendicular to the axis of the electric wire. Consequently, the connector terminal is firmly crimped to the conductor of the electric wire, whereby superior electrical continuity to the conductor is established.

At this time, the depth of the trench or the projecting dimension of the projection is made smaller than a covering thickness of the covering of the conductor. Hence, the conductor is crimped to the barrel portion without breaking the covering between the barrel portion and the conductor. Therefore, exposure of the conductor, which would otherwise be caused by a break in the covering at a crimped area of the barrel portion, can be prevented, so that an anticorrosion effect of the conductor exhibited by the covering can be maintained. Consequently, even when dissimilar metals are connected to each other, occurrence of electrical corrosion, such as bimetallic corrosion, in a connection portion can be prevented without molding the connection area in resin by means of the molding machine. Specifically, the connecter terminal can be connected to the electric wire without fail, and a superior anticorrosion property can be yielded at the area where the connector terminal is connected to the conductor while saving costs of facilities and manufacturing costs is achieved by obviating a necessity for the molding machine and the molding resin. Expanding wire harness to a manufacturing plant can be practiced with advantage.

In the connector terminal having the configuration defined in (2), the barrel portion is crimped to the conductor, whereby the forefront of the conductor is sealed by the sealing piece. The conductor of the thus-crimped electric wire can be covered with the barrel portion without fail, so that the covering can be effectively protected.

In the connector terminal having the configuration defined in (3), the core wire crimping portion and the outer cover crimping portion, which are separated from each other, are crimped to the conductor and the outer cover, which differ from each other in terms of an outer diameter, independently. The connector terminal can be connected to the end of the electric wire without fail.

In the connector terminal having the configuration defined in (4), the core wire crimping portion and the outer cover crimping portion, which are separated from each other, are crimped to the conductor and the outer cover, which differ from each other in terms of an outer diameter, independently. The connector terminal can be connected to the end of the electric wire without fail.

The invention makes it possible to provide a connector terminal that can be connected to an electric wire without fail and exhibit a superior anticorrosion property at the connection portion of the connector terminal to be connected to a conductor while saving costs of facilities and manufacturing costs is achieved.

The invention has been briefly described thus far. Details of the invention will be clarified further by reading through an embodiment for implementing the invention to be described below by reference to the accompanying drawings.

BRIEF DESCRIPTION OF THE DRAWINGS

FIGS. 4A and 4B are illustrations showing the connector terminal, wherein FIG. 4A is a cross section of the entirety of the connector terminal and FIG. 4B is an enlarged cross section of a barrel portion;

DETAILED DESCRIPTION OF THE EXEMPLARY EMBODIMENTS

An exemplary embodiment of the invention is hereunder described by reference to the drawings.

Figure 1:
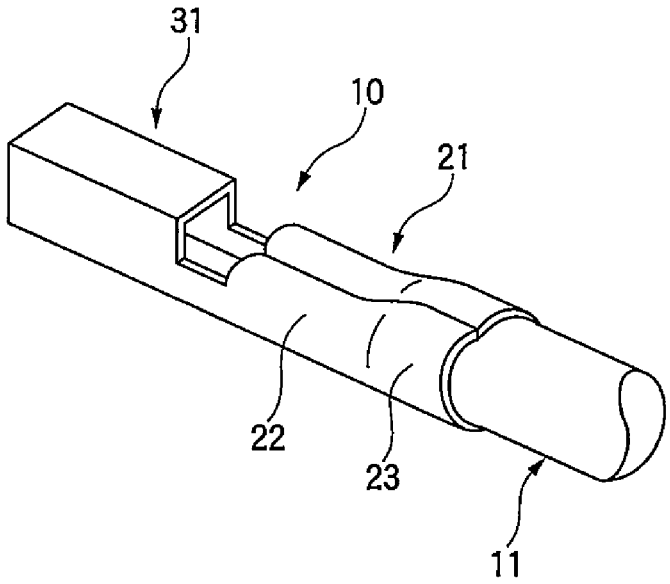
FIG. 1 is a perspective view showing a connector terminal of an embodiment of the invention.
Figure 2:
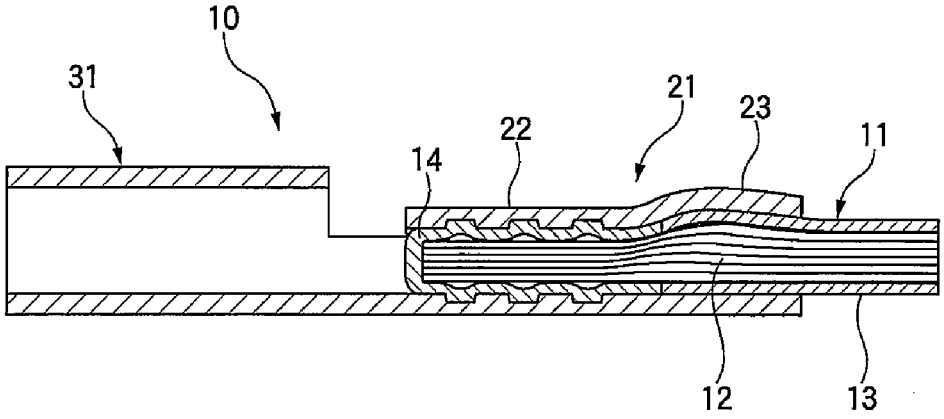
FIG. 2 is a cross section showing the connector terminal of the embodiment of the invention.
Figure 3:
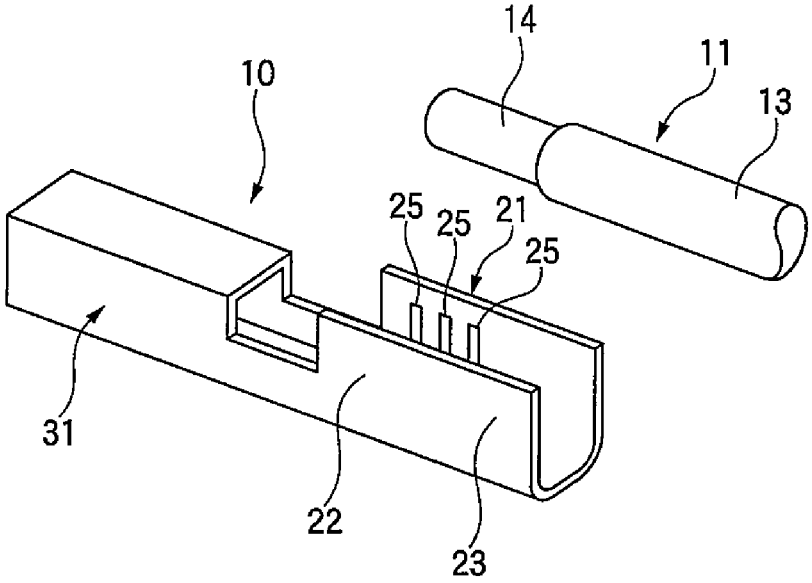
FIG. 3 is an exploded perspective view showing the connector terminal of the embodiment of the invention.
Figure 4A:
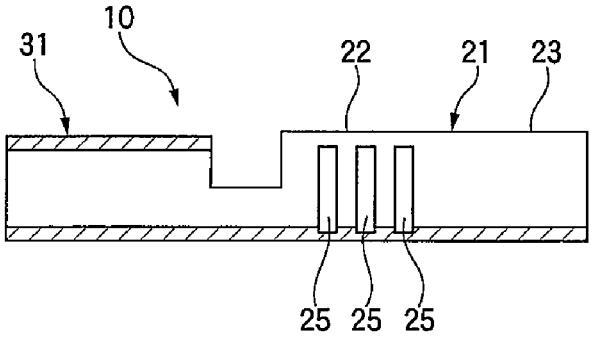
Figure 4B:
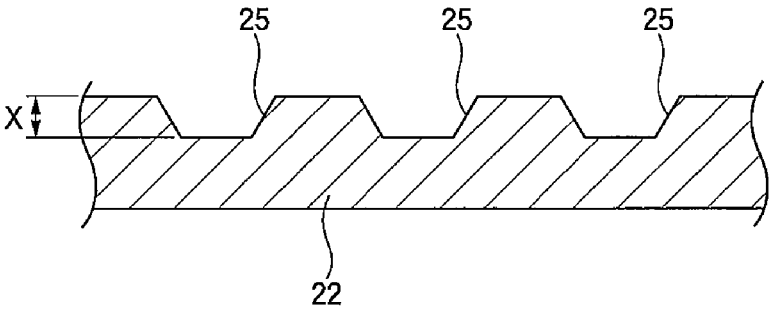
Figure 5:
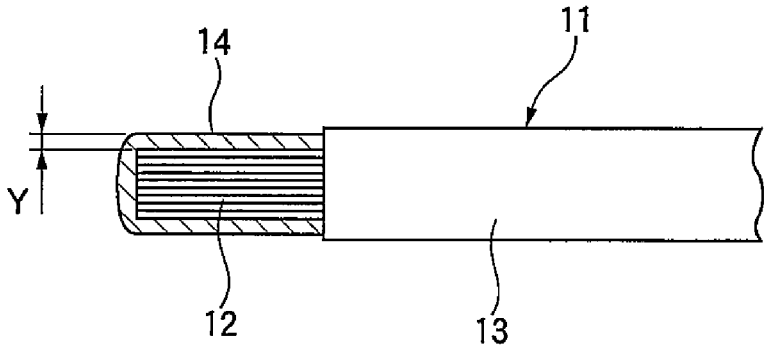
FIG. 5 is a side elevation of a portion of an end of an electric wire to which the connector terminal is to be connected when viewed in cross section.
Figure 6:
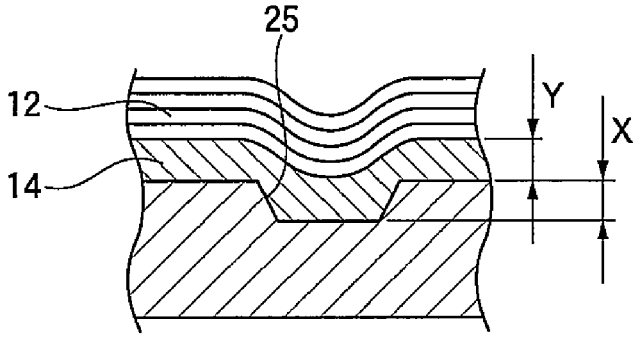
FIG. 6 is a cross section of the barrel portion of the connector terminal connected to the electric wire.

FIG. 1 is a perspective view showing a connector terminal of an embodiment of the invention; FIG. 2 is a cross section showing the connector terminal of the embodiment of the invention; FIG. 3 is an exploded perspective view showing the connector terminal of the embodiment of the invention; FIGS. 4A and 4B are illustrations showing the connector terminal, wherein FIG. 4A is a cross section of the entirety of the connector terminal and FIG. 4B is an enlarged cross section of a barrel portion; FIG. 5 is a side elevation of a portion of an end of an electric wire to which the connector terminal is to be connected when viewed in cross section; and FIG. 6 is a cross section of the barrel portion of the connector terminal connected to the electric wire.

As shown in FIGS. 1 through 3, a connector terminal 10 is connected to an electric wire 11. The electric wire 11 has a core wire (conductor) 12 made of aluminum and an outer cover 13 extruded so as to cover a periphery of the core wire 12.

The connector terminal 10 is formed by; for instance, pressing, a conductive metallic material, such as copper or a copper alloy, and has a barrel portion 21 and an electrical connection portion 31.

A forefront-side area of the barrel portion 21; namely, an area close to the electrical connection portion 31, is formed as a core wire crimping portion 22, whilst a rear-end-side of the barrel portion 21 is formed as an outer cover crimping portion 23. The barrel portion 21 is formed into the shape of the letter U or an indentation that is opened upward when viewed from the front. The barrel portion 21 is crimped while an end of the electric wire 11 is placed in the barrel portion 21.

As shown in FIGS. 4A and 4B, a plurality of trenches 25, each of which has a depth X, are formed in an inner surface of the core wire crimping portion 22 of the barrel portion 21 of the connector terminal 10. The trenches 25 are formed along a direction perpendicular to an axis of the electric wire 11 to be connected and spaced apart from each other.

As shown in FIG. 5, in the electric wire 11 to which the connector terminal 10 is to be connected, an exposed portion of an end of the outer cover 13 of the core wire 12 made of aluminum is soldered. A periphery of the exposed portion of the core wire 12 is covered with a covering 14 made of solder, and corrosion of the core wire 12 made of aluminum is prevented by the covering 14. The covering 14 provided around the core wire 12 is set to a covering thickness Y.

A depth X of each of the trenches 25 formed in the core wire crimping portion 22 of the barrel portion 21 of the connector terminal 10 is set so as to become smaller than the covering thickness Y of the covering 14 of the core wire 12 ($X<Y$).

In order to connect the electric wire 11 to the connector terminal 10, the barrel portion 21 is forcefully bent inwards and crimped by means of a crimper while the end of the electric wire 11 is placed in the barrel portion 21 of the connector terminal 10. When the barrel portion 21 is forcefully bent inwards by the crimper, the core wire crimping portion 22 of the barrel portion 21 is crimped to the core wire 12 of the electric wire 11 placed in the barrel portion 21, and the outer cover crimping portion 23 is crimped to the outer cover 13 of the electric wire 11. The connector terminal 10 is thereby connected to the electric wire 11 while electrical continuity between the core wire 12 of the electric wire 11 and the connector terminal 10 is established. The core wire 12 covered with the covering 14 bites into the plurality of trenches 25 formed in the inner surface of the barrel portion 21 along the direction perpendicular to the axis of the electric wire 11. Therefore, the connector terminal 10 is firmly crimped to the core wire 12 of the electric wire 11, whereby superior electrical continuity is established between the core wire 12 and the connector terminal 10.

As shown in FIG. 6, the depth X of the trenches 25 formed in the core wire crimping portion 22 of the barrel portion 21 of the connector terminal 10 is set so as to become smaller than the covering thickness Y of the covering 14 of the core wire 12. The core wire 12 is crimped to the barrel portion 21 without breaking the covering 14 located between the barrel portion 21 and the core wire 12. Consequently, exposure of the core wire 12, which would otherwise be caused by a break in the covering 14 at a crimped area of the barrel portion 21, is prevented, so that an anticorrosion effect of the core wire 12 yielded by the covering 14 is maintained.

As has been described above, in the connector terminal of the embodiment, the core wire 12 coated with the covering 14 bites into the trenches 25 formed in the inner surface of the barrel portion 21 along the direction perpendicular to the axis of the electric wire 11. Hence, the barrel portion can be firmly crimped to the core wire 12 of the electric wire 11, and superior electrical continuity with the core wire 12 can be established.

Furthermore, since the depth X of each of the trenches 25 is made smaller than the covering thickness Y of the covering 14 of the core wire 12, the core wire 12 is crimped to the barrel portion 21 without breaking the covering 14 located between the barrel portion 21 and the core wire 12. Consequently, exposure of the core wire 12, which would otherwise be caused by a break in the covering 14 at the crimped area, can be prevented, and the anticorrosion effect of the core wire 12 exhibited by the covering 14 can be maintained. Therefore, even when dissimilar metals are connected to each other, occurrence of electrical corrosion, such as bimetallic corrosion, in a connection portion can be prevented without molding the connection area in resin. Specifically, the connecter terminal can be connected to the electric wire 11 without fail, and a superior anticorrosion property can be yielded at the area where the connector terminal is connected to the core wire 12 while saving costs of facilities and manufacturing costs is achieved by obviating a necessity for the molding machine and the molding resin. Expanding wire harness to a manufacturing plant can be practiced with advantage.

In the embodiment, the plurality of trenches 25 oriented along the direction perpendicular to the axis of the electric wire 11 are formed in an inner surface of the core wire crimping portion 22 of the barrel portion 21. However, a plurality of projections oriented along the direction perpendicular to the axis of the electric wire 11 can also be formed in place of the trenches 25. In this case, a projecting dimension of each of the projections is set so as to become smaller than the covering thickness Y of the covering 14. The barrel portion 21 is crimped to the core wire 12 without breaking the covering 14 between the barrel portion 21 and the core wire 12, thereby preventing exposure of the core wire 12, which would otherwise be caused by a break in the covering 14 at a crimped area and maintaining an anticorrosion effect of the covering 14 exhibited by the core wire 12.

Although the connector terminal 10 is connected to the core wire 12 covered with the covering 14 that covers the exposed area and that is formed from solder, the covering 14 that covers the core wire 12 is not limited to solder but may also be conductive paste, or the like.

Figure 7:
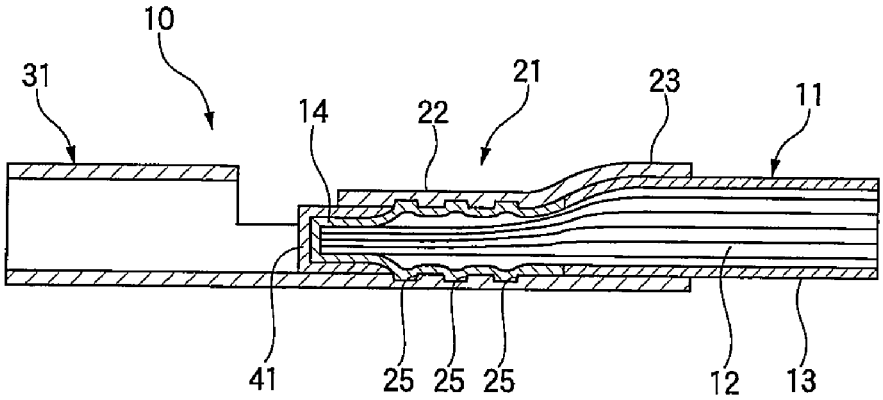
FIG. 7 is a cross section of the connector terminal connected to the electric wire covered with a seal cap.

As shown in FIG. 7, a seal cap 41 formed from an elastic material exhibiting a waterproof property, such as rubber, may be put on the forefront of the core wire 12 of the electric wire 11 when the connector terminal 10 is crimped to the electric wire 11.

As above, if the connector terminal 10 is crimped to the electric wire 11 while the forefront of the core wire 12 of the electric wire 11 is covered with the seal cap 41, the forefront of the core wire 12 is covered with the seal cap 41, so that protection of the core wire 12 and enhancement of the anticorrosion property of the core wire 12 can be achieved.

A connector terminal of an exemplary modification will now be described.

Figure 8:
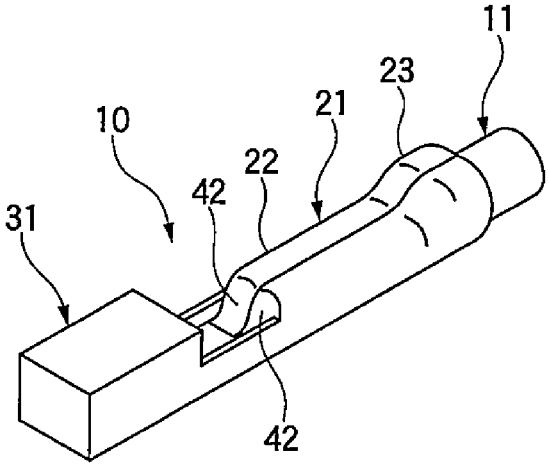
FIG. 8 is a perspective view of a connector terminal of an exemplary modification.
Figure 9:
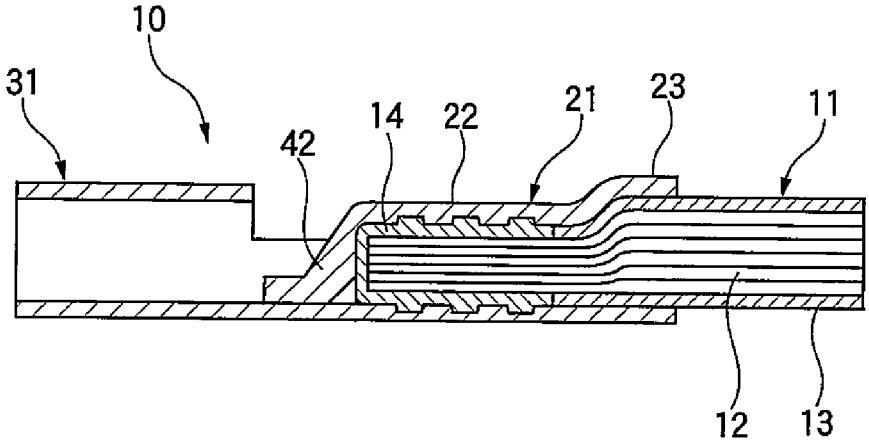
FIG. 9 is a cross section of the connector terminal of the exemplary modification.

FIG. 8 is a perspective view of the connector terminal of the exemplary modification, and FIG. 9 is a cross section of the connector terminal of the exemplary modification.

As shown in FIGS. 8 and 9, a sealing piece 42 is formed on a side of the barrel portion 21 facing the electrical connection portion 31 in the connector terminal 10. In the connector terminal 10, the sealing piece 42 is also crimped when the barrel portion 21 is crimped to the end of the electric wire 11, and the forefront of the core wire 12 is sealed by the sealing piece 42.

As above, in the connector terminal 10, the core wire 12 of the thus-crimped electric wire 11 can be covered with the barrel portion 21 without fail, so that the core wire 12 covered with the covering 14 can be effectively protected.

Figure 10:
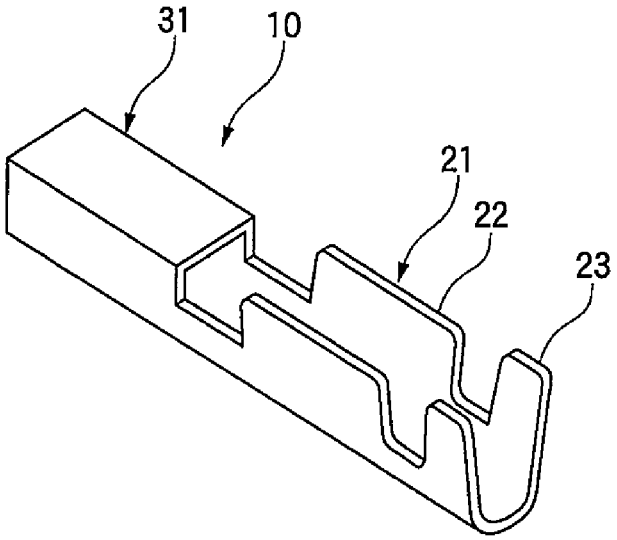
FIG. 10 is a perspective view of the connector terminal of the exemplary modification.

FIG. 10 is a perspective view of the connector terminal of the exemplary modification.

As shown in FIG. 10, the connector terminal 10 includes the core wire crimping portion 22 and the outer cover crimping portion 23 which make up the barrel portion 21 and which are separated from each other. When the connector terminal 10 is crimped to the end of the electric wire 11 by swaging the barrel portion 21, the core wire crimping portion 22 and the outer cover crimping portion 23, which are separated from each other, independently come to be crimped to the core wire 12 and the outer cover 13 that differ from each other in terms of an outer diameter. The connector terminal 10 can be connected to the end of the electric wire 11 more reliably.

The invention is not limited to the embodiment and is susceptible to alterations, modifications, and others, as necessary. In addition, a material, a shape, a dimension, the number, a location, and the like, of each of the constituent elements in the embodiment are arbitrary and unlimited, so long as the invention can be accomplished.

The invention makes it possible to provide a connector terminal that can be connected to an electric wire without fail and exhibit a superior anticorrosion property at the connection portion of the connector terminal to be connected to a conductor while saving costs of facilities and manufacturing costs is achieved.

What is claimed is:

1. A connector terminal connected to an electric wire in which a conductor is covered with an outer cover, the terminal comprising:

a barrel portion that is exposed from the outer cover and is to be crimped to the conductor coated with a covering; and an electrical connection portion electrically connected to a mating terminal, wherein a trench or a projection that is provided along a direction perpendicular to an axis of the electric wire are formed in an inner surface of the barrel portion; and a depth of the trench or a projecting dimension of the projection is made smaller than a covering thickness of the covering.

2. The connector terminal according to claim 1, wherein the barrel portion includes a sealing piece that seals a forefront of the conductor when the conductor is crimped.

3. The connector terminal according to claim 1, wherein the barrel portion is divided into a core wire crimping portion crimping the conductor and an outer cover crimping portion crimping the outer cover.

4. The connector terminal according to claim 2, wherein the barrel portion is divided into a core wire crimping portion crimping the conductor and an outer cover crimping portion crimping the outer cover.

* * * * *